US007440713B2

(12) United States Patent
Sone et al.

(10) Patent No.: US 7,440,713 B2
(45) Date of Patent: Oct. 21, 2008

(54) FIXING DEVICE OF IMAGE FORMING APPARATUS AND IMAGE FORMING APPARATUS

(75) Inventors: Toshihiro Sone, Kanagawa-ken (JP); Osamu Takagi, Tokyo (JP); Satoshi Kinouchi, Tokyo (JP); Yoshinori Tsueda, Shizuoka-ken (JP)

(73) Assignees: Kabushiki Kaisha Toshiba, Tokyo (JP); Toshiba TEC Kabushiki Kaisha, Tokyo (JP)

( * ) Notice: Subject to any disclaimer, the term of this patent is extended or adjusted under 35 U.S.C. 154(b) by 423 days.

(21) Appl. No.: 11/384,551

(22) Filed: Mar. 20, 2006

(65) Prior Publication Data

US 2007/0217819 A1 Sep. 20, 2007

(51) Int. Cl.
*G03G 15/20* (2006.01)

(52) U.S. Cl. ..... 399/122

(58) Field of Classification Search ..... 399/69, 399/99, 122, 320, 328, 330, 335; 219/216
See application file for complete search history.

(56) References Cited

U.S. PATENT DOCUMENTS

| | | | | |
|---|---|---|---|---|
| 5,287,155 | A * | 2/1994 | Arai et al. | 399/69 |
| 7,027,075 | B2 * | 4/2006 | Yokoi | 347/156 |
| 7,062,187 | B2 * | 6/2006 | Peng et al. | 399/69 |
| 7,079,782 | B2 * | 7/2006 | Sone et al. | 399/69 |
| 7,106,985 | B2 * | 9/2006 | Sone et al. | 399/69 |
| 2007/0177895 | A1 * | 8/2007 | Yano | 399/122 |

FOREIGN PATENT DOCUMENTS

| | | | |
|---|---|---|---|
| JP | 61091679 | A * | 5/1986 |
| JP | 04115283 | A * | 4/1992 |
| JP | 08-305216 | | 11/1996 |
| JP | 11102139 | A * | 4/1999 |
| JP | 2001228738 | A * | 8/2001 |
| JP | 2002-340682 | | 11/2002 |
| JP | 2003-004536 | | 1/2003 |
| JP | 2005227558 | A * | 8/2005 |

* cited by examiner

*Primary Examiner*—Robert Beatty
(74) *Attorney, Agent, or Firm*—Amin, Turocy & Calvin, LLP

(57) ABSTRACT

The fixing device of the image forming apparatus of the present invention has a cleaning pad arranged on the upper frame which supports a heat roller. An infrared temperature sensor is supported by a supporting mechanism that is capable of supporting the infrared temperature sensor at the temperature detecting position and the evacuating position. When the right and left frames are attached/removed to/from the main body of the apparatus at the time of maintenance, the infrared temperature sensor is moved to the evacuating position and pressed against the cleaning pad and then, the right and left frames are moved by sliding to the main body of the apparatus. The cleaning pad is also slid and moved jointly with the slide moving of the right and left frames, and the infrared temperature sensor contacts the cleaning pad and dirt on the infrared temperature sensor is removed. As a result of the improvement of temperature detecting accuracy of the infrared temperature sensor, the temperature control of the heat roller is improved and fixed image of high quality is obtained.

19 Claims, 4 Drawing Sheets

FIXING DEVICE OF IMAGE FORMING APPARATUS AND IMAGE FORMING APPARATUS

FIELD OF THE INVENTION

The present invention relates to a fixing device provided in an image forming apparatus such as a copying machine, printer, facsimile, etc.

DESCRIPTION OF THE BACKGROUND

As a fixing device used in image forming apparatus such as electro-photographic copying machines, printers, facsimiles, there is a fixing device which heats, pressurizes and fixes a toner image by inserting a sheet paper between a pair of rollers comprising a heat roller and a pressure roller or similar belts. In this heating type fixing device, in order to maintain heat rollers at a constant temperature able to fix images, surface temperature of the heat roller is detected by a heat sensor and a heat source is controlled by turning it ON/OFF according to the detected result.

In recent years, a non-contact type temperature sensor is used, which detects temperature without contacting members to be heated such as heat rollers, fixing belts like a thermopile type infrared temperature sensor. This temperature sensor assures the long life of heat rollers without injuring the surfaces of heating members.

For this non-contact type infrared temperature sensor, it is necessary to remove dirt adhered to the lens surface of the sensor in order to obtain the high detecting accuracy. Therefore, at the time when a fixing device was pulled out from the main body of an image forming apparatus for the service maintenance, the jam process or exchange of the fixing device at the end of its service life, it was so far required to wipe off dirt on the temperature sensor installed in the main body by a service man. Further, there is a device to wipe off dirt on a filter by reciprocating a cleaner of the front surface of the temperature sensor filter.

However, in the case of a conventional fixing device wherein its temperature sensor is cleaned by a service man by wiping off the sensor at the time of checking, the workability of a service man will drop. Further, in the case of a conventional fixing device wherein a cleaner or filter is moved, a moving mechanism becomes necessary, the device will be complicated and the downsizing of the apparatus is checked.

So, in the field of a fixing device to heat and fix images, it is desirable to develop a fixing device of an image forming apparatus, capable of easily removing dirt adhered on the surface of a thermopile type temperature sensor to detect surface temperature of units to be heated, promoting the detecting accuracy of the temperature sensor, obtaining high image quality by precisely controlling temperatures of heating members and furthermore, without impairing the maintenance efficiency by promoting the fixing performance, and achieving downsizing of an image forming apparatus simple in structure.

SUMMARY OF THE INVENTION

The object of the present invention is to remove dirt adhered on the surface of a non-contact type temperature sensor that is to detect the surface temperature of a heat roller when heating members are exchanged or attached or detached to/from the main body for maintenance and obtain a high quality for a good fixing efficiency by precisely controlling the heating members without impairing the maintenance efficiency by servicemen, not requiring a driving mechanism and further, without impairing the downsizing of the apparatus.

According to the embodiments of the present invention, there is provided a fixing device of an image forming apparatus comprising a heating member to contact a medium and fix a toner image on the medium; a heat source member to heat the heating member; a detachable frame to support the heating member detachably to/from a main body of an image forming apparatus; a non-contact temperature detecting member to detect the surface temperatures of the heating member; and a supporting mechanism to support the temperature detecting member at a temperature detecting position and support the temperature detecting member at an evacuating position when detaching the heating frame.

DETAILED DESCRIPTION OF THE INVENTION

Figure 1:
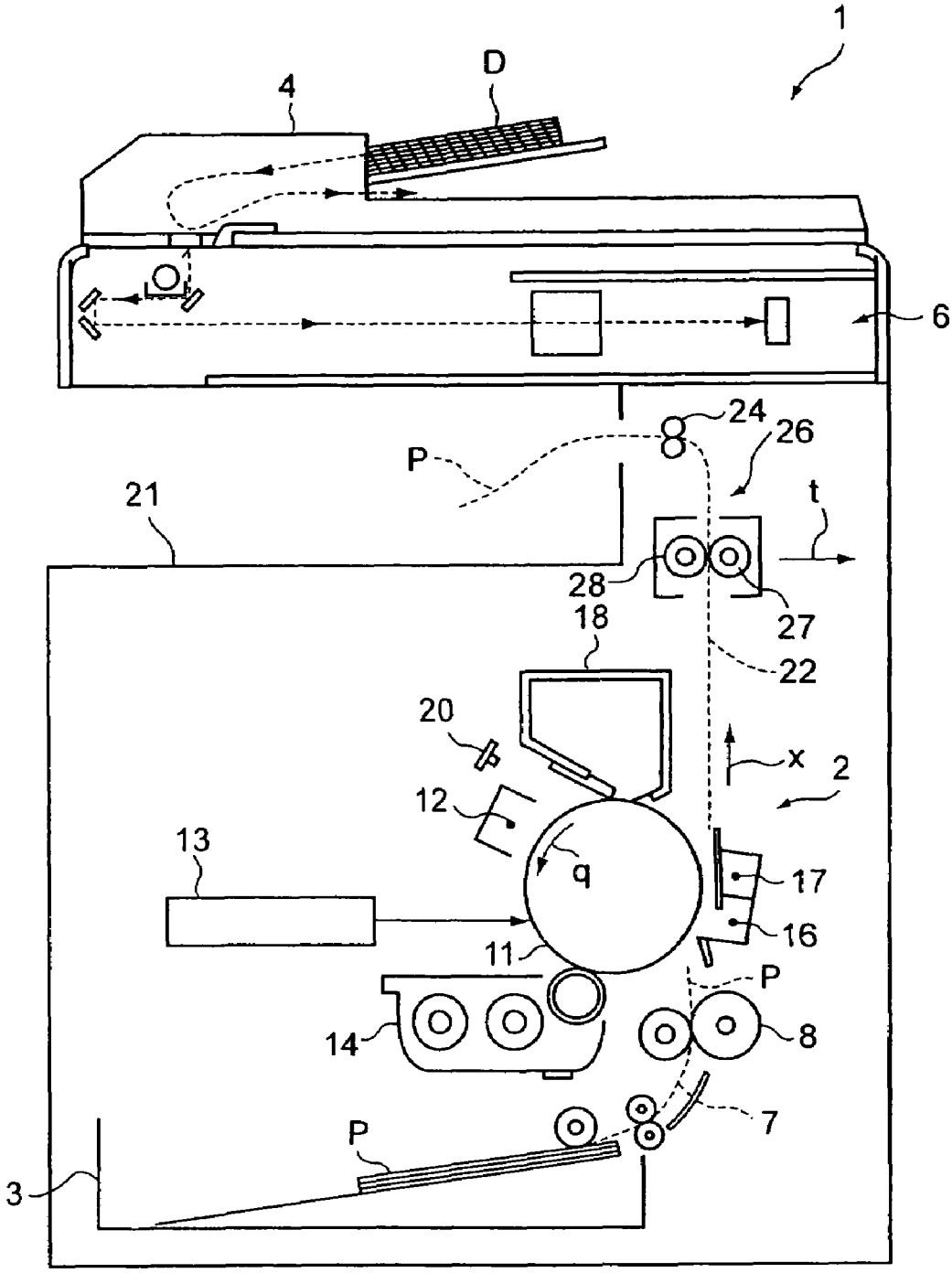
FIG. 1 is a schematic construction diagram showing an image forming apparatus in the first embodiment of the present invention.

The first embodiment of the present invention will be described below in detail referring to the attached drawings. FIG. 1 is a schematic construction diagram showing an image forming apparatus 1 equipped with a fixing device 26 in the first embodiment of the present invention. Image forming apparatus 1 is equipped with a cassette mechanism 3 to supply paper P that is a fixing medium to image forming unit 2 and a scanner unit 6 which reads a document D supplied from an automatic document feeder 4 on the upper surface. On a conveying path 7 from cassette mechanism 3 to image forming unit 2, an aligning roller 8 is provided.

Image forming unit 2 has a charging unit 12 to uniformly charges a photosensitive drum 11, a laser exposure unit 13 to form a latent image on charged photosensitive drum 11 based on image data supplied from scanner unit 6, a developing unit 14, a transferring charger 16, a separation charger 17, a cleaner 18 and a charge elimination LED 20 around photosensitive drum 11 according to the rotating direction of photosensitive drum 11 in an arrow direction "q". Image forming unit 2 forms a toner image on photosensitive drum 11 in the image forming process according to a well-known electrophotographic system and transfers the image on a paper P.

At the downstream in the arrow direction "x" that is the conveying direction of paper P of image forming unit 2, an ejected paper conveying path 22 is provided to convey a paper P with a y toner image transferred in the direction of a paper ejection unit 21. On ejected paper conveying path 22, fixing device 26 to fix a paper P separated from photosensitive drum 11 and a paper ejection roller 24 to eject paper P after passing fixing device 26 to paper ejection unit 21 are provided.

Figure 2:
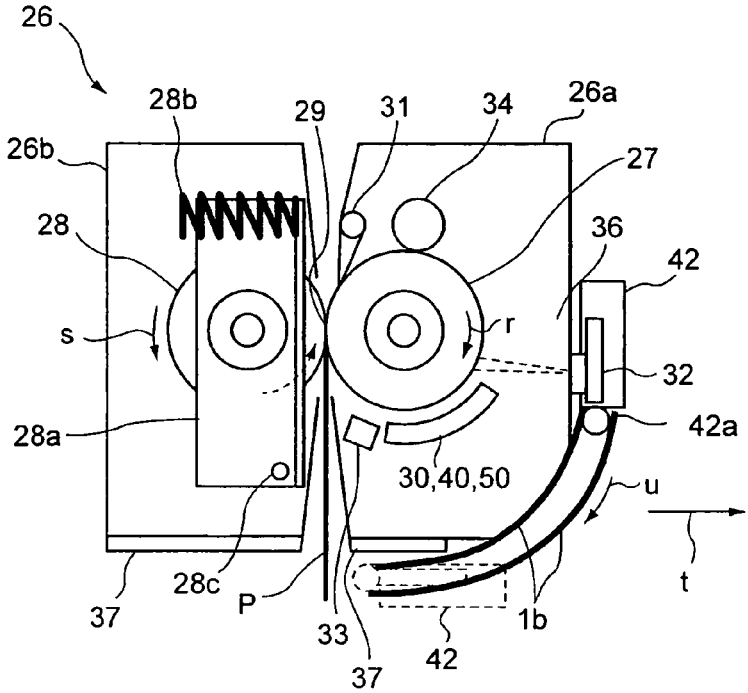
FIG. 2 is a schematic construction diagram of a fixing device viewed from the axial direction of heat rollers in the first embodiment of the present invention.
Figure 3:
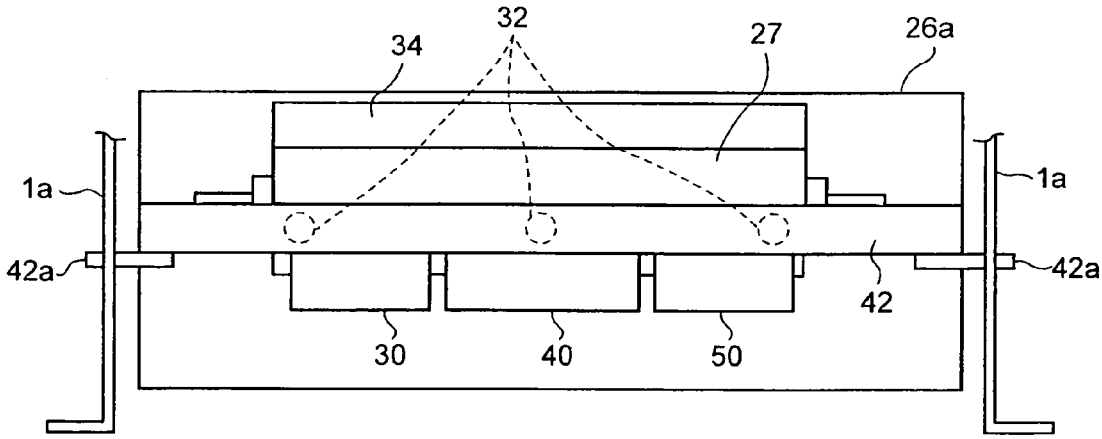
FIG. 3 is a schematic layout diagram of the fixing device viewed from the direction orthogonal to the axes of the heat rollers in the first embodiment of the present invention.
Figure 4:
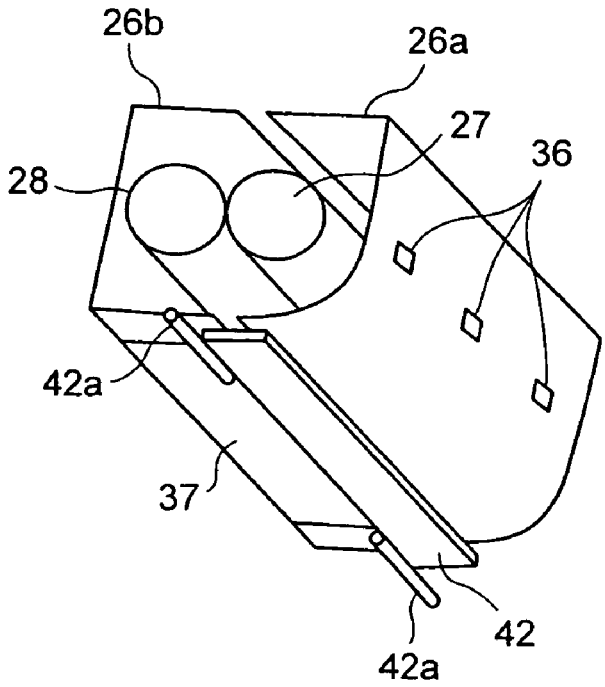
FIG. 4 is a schematic perspective view showing the fixing device in the first embodiment of the present invention.

Next, fixing device 26 will be described. FIG. 2 is a schematic construction diagram of fixing device 26 viewed from the axial direction of a heat roller 27, FIG. 3 is a schematic layout diagram of fixing device 26 viewed from the axially orthogonal direction, and FIG. 4 is a schematic perspective view of fixing device 26. Fixing unit 26 is a unit to be heated and has a fixing roller pair; a heat roller 28 rotating in the arrow direction "r" and a pressure roller 28 rotating in the arrow direction "s" by press fitted to heat roller 27.

Heat roller 27 has a metallic conductive layer through foaming rubber around a core metal. Pressure roller 28 is coated with a surface layer of silicon rubber or fluoride rubber around the core metal. Pressure roller 28 pushes an axis 28*c* against the heat roller 27 side by a pressure spring 28*b* through a pressure arm 28*a*. As a result, pressure roller 28 is press contacted to heat roller 27 and a nip 29 in a certain width is formed between heat roller 27 and pressure roller 28.

Heat roller 27 is supported buy a right frame 26*a* and pressure roller 28 is supported by a left frame 26*b*. Right and left frames 26*a*, 27*b* compose a detachable frame capable of reciprocating slide in the arrow direction "t" or the reverse direction shown in FIG. 2 and able to detach heat roller 27 and pressure roller 28.

Further, fixing device 26 has induction heat coils 39, 40 and 50 which are heat source members for 100V power source to heat roller 27 via about 1.5 mm gap around the periphery of heat roller 27. Induction heat coils are almost in the coaxial shape of heat roller 27.

Induction heat coils 30, 40 and 50 generate magnetic fields by supplied driving current and heat roller 27 by generating eddy current in the metal induction layer of the surface of heat roller 27 by the magnetic field. Induction heat coils 30, 40 and 50 are divided and laid in the longitudinal direction of heat roller 27 and heat the opposite areas of heat roller 27, respectively. Power values of induction heat coils 30, 40 and 50 are controlled according to frequency of driving current and temperature of heat roller 27 is controlled by varying a calorific value of the metal induction layer of heat roller 27 by power value of respective induction coils 30, 40 and 50.

Further, on the periphery of heat roller 27, a thermostat 33 to shut off the heating by detecting abnormal surface temperature of heat roller 27, a separation claw 31 to prevent winding of paper P after fixing and a cleaning roller 34 are provided.

On the outer side of right frame 26*a*, openings 36 are formed and temperature sensors 32 to detect the surface temperature of heat roller 27 without contacting it are arranged in areas corresponding to respective induction heat coils 30, 40 and 50. Temperature sensors 32 detect the surface temperature of heat roller 27 from nip 29 to reach respective induction heat coils 30, 40 and 50. Thus, temperature sensors 32 make the highly accurate fixing control by controlling power values of induction heat coils 30, 40 and 50 required in the next fixing by detecting the temperature of heat roller 27 dropped after passing nip 29.

Further, a contact type thermistor (not shown) may be provided near thermostat 33 to correct the detected temperature of temperature sensors 32 by comparing the temperature of temperature sensors with detected output of this thermistor.

Figure 5:
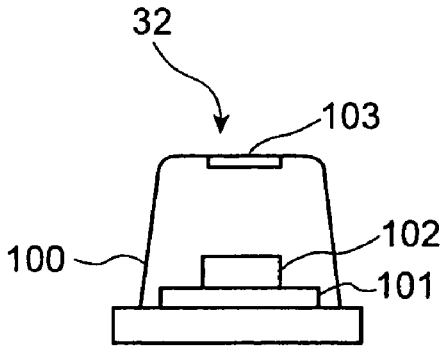
FIG. 5 is a schematic explanatory diagram showing an infrared temperature sensor in the first embodiment of the present invention.
Figure 6:
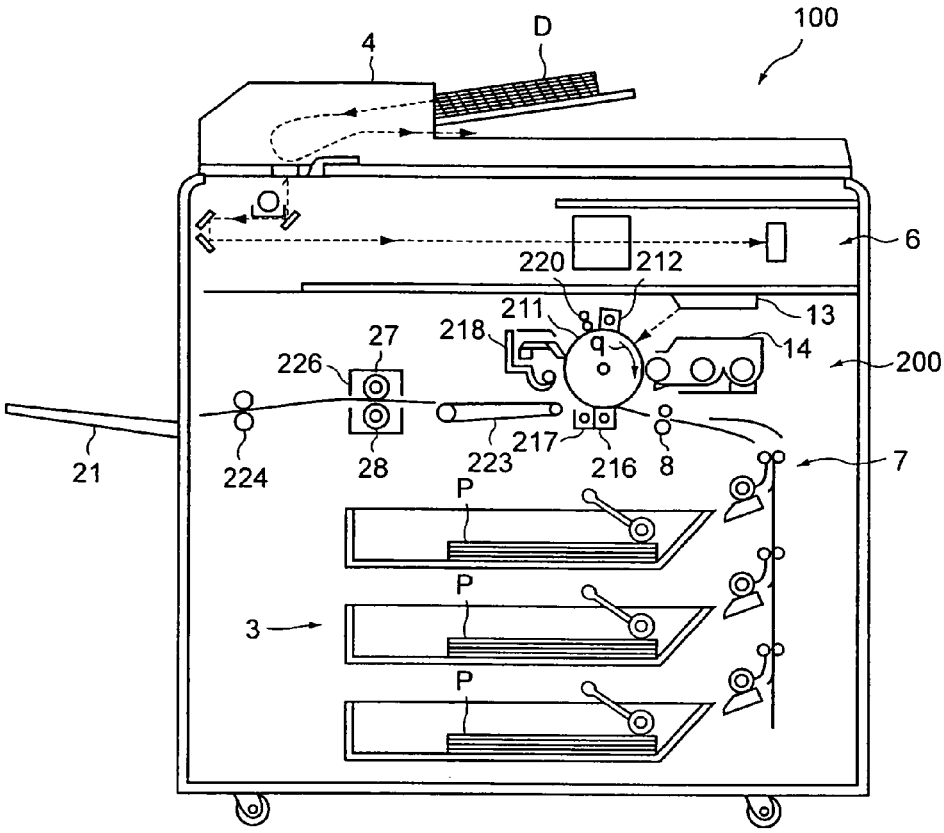
FIG. 6 is a schematic construction diagram showing the image forming unit of the image forming apparatus in the second embodiment of the present invention.

Temperature sensor 32 has a thermopile 102 with many thin film thermocouple comprising polysilicon and aluminum connected in series on a silicon panel 101 provided in a housing 100 as shown in FIG. 5. Housing 100 has a silicon lens 103 and focuses the infrared ray from heat roller 27 on thermopile 102. The temperature change of the hot contact point generated on thermopile when the infrared ray is received is detected as a starting power of the thermocouple.

In temperature sensor 32 of this embodiment, the range of detecting infrared ray wavelength is set at 3.07 to 10.81 μm. The detecting range is set by infrared ray filters so as to cut wavelengths that become noise out of those in various wavelengths. By using such infrared ray filters, it is possible to reduce error in detected temperature by infrared ray energy in wavelength that becomes noise.

Temperature sensor 32 is installed by fixing with screws or pins to a supporting plate 42 that comprises a supporting mechanism. Supporting plate 42 is provided with slide pins 42*a* at both ends. Slide pins 42*a* are fitted into rails 1*b* formed on a main body frame 1*a* of image forming apparatus 1. Supporting plate 42 is able to support a temperature sensor 32 by pressing it at a temperature detecting position at opening 36 of right frame 26*a* and the evacuating position on the upper surface of right frame 26*a* by sliding slide pins 42*a* in the arrow direction "u" or in the reverse direction along rail 1*b*. The supporting mechanism is composed of supporting plate 42 and rail 1*b*.

At the positions opposite to temperature sensors 32 at the evacuating positions, web or fiber shape cleaning pads 37 are provided on the bottom surface of the right and left frames 26*a*, 26*b*. Cleaning pad 37 has the width of at least silicon lens 103 of temperature sensor 32 and extended in the sliding direction in the arrow direction "t" of fixing device 26. Cleaning agent such as alcohol or ethanol or silicon cleaning agent is impregnated in advance in cleaning pad 37.

The surface of temperature sensor 32 is compressed against cleaning pad 37 at the evacuating position at a pressure, for example, about 150 g/cm$^2$. As a result, the surface of temperature sensor 32 is brought in contact to cleaning pad 37 with the sliding movement of right and left frames 26*a*, 26*b* and cleaned by removing dirt adhered thereon.

Next, the operations will be described. When the power source of image forming apparatus is turned ON, heat roller 27 is warmed up over the whole area in the axial direction which is the scanning direction. The surface temperature of heat roller 27 is detected by temperature sensor 32 and thermistor 33. After heat roller 27 reached a ready temperature, output power values of induction heating coils 30, 40 and 50 are controlled so as to keep the ready temperature. At this time, temperature sensor 32 is kept at the temperature detecting position.

At the ready state, the printing operation is directed and the image forming process is started. In image forming unit 2, photosensitive drum 11 rotating in the arrow direction "q" is uniformly charged by a main charger 12 and laser beam is irradiated corresponding to a document data by laser exposing unit 13 and a latent image is formed. Then, the latent image is developed by developing device 14 and a toner image is formed on photosensitive drum 11.

The toner image on photosensitive drum 11 is transferred on a paper P by transfer charger 16. Then, the paper P is separated from photosensitive drum 11 and conveyed to fixing device 26. The paper P conveyed to fixing device 26 is heated to a fixable temperature, for example, 160° C., and inserted between heat roller 27 rotating in the arrow direction "r" and pressure roller 28 rotating in the arrow direction "s" and a toner image is heated, pressurized and fixed.

While a toner image is being fixed, the surface temperature of heat roller 27 immediately before the fixing operation at the upstream of nip 29 is detected by temperature sensor 32 and thermistor 33 in fixing device 26. Supplied power to induction heating coils 30, 40 and 50 is adjusted according to the result of detection and the surface temperature of heat roller 27 is high precisely controlled to keep 160° C.±10° C. Thus, the toner image is fixed satisfactorily on the paper P.

While the image forming is made as described, when the jamming process of paper P, periodic maintenance by serviceman or exchange for lifetime over becomes necessary and heat roller 27 and pressure roller 28, right and left frames 26*a*, 26*b* are pulled out in the arrow direction "t". When pulling out right and left frames 26*a*, 26*b* in the arrow direction "t", first move supporting plate 42 along rail 1*b* formed on the main frame in the arrow direction "u" by opening the side cover. Temperature sensor 32 is moved to the evacuation position on the bottom surface of right frame 26*a* from the temperature detecting position and is pressed against cleaning pad 37.

Then, when right and left frames 26*a*, 26*b* are pulled out in the arrow direction "t" from image forming apparatus 1, temperature sensor 32 is slide and contacted to cleaning pad 37 that is slid with the sliding right frame 26*a*. Thus, the surface of temperature sensor 32 is automatically cleaned and dirty matter adhered thereon is removed by cleaning pad 37. Further, when right and left frames 26*a*, 26*b* are slid in the direction reverse to the arrow direction "t" and installed in the main body of image forming apparatus 1, the surface of temperature sensor 32 is slide and contacted to cleaning pad 37 and is automatically cleaned. As a result, dirt on the surface of temperature sensor 32 is removed and its surface is restored to the state wherein the surface temperature of heat roller 27 can be detected high precisely.

Hereafter, supporting plate 42 is moved along rail 1*b* in the direction reverse to the arrow direction "u" and temperature sensor 32 is returned to the temperature detecting position and restored to the state able to make the image forming process.

According to this embodiment, at the time of maintenance, temperature sensor 32 is moved from the temperature detecting position to the evacuating position where it is pressed against cleaning pad 37 on the upper surface of right frame 26*a*. Then, temperature sensor 32 is slid to image forming apparatus 1 for detaching or attaching right and left frames 26*a* and 26*b*. Therefore, the surface of temperature sensor 32 is slid and contacted to cleaning pad 37 and dirt on the surface is removed.

Next, a second embodiment of this invention will be explained. This second embodiment is to fix a toner image while conveying a paper taken out of the cassette mechanism horizontally in the first embodiment described above. Further, at the time of maintenance, the detachable frames are pulled out to the front side and other components are the same as those components in the first embodiment. Accordingly, in this second embodiment, the same structures as those explained in the first embodiment are assigned with the same reference numerals and the detailed explanation thereof will be omitted.

An image forming unit 200 of an image forming apparatus 100 in this embodiment is provided with a main charger 212, a laser exposure unit 213, a developing device 214, a transfer charger 216, a separation charger 217, a cleaner 218 and a charge elimination LED 220 around a photosensitive drum 211 which rotates in the arrow direction "n".

Figure 7:
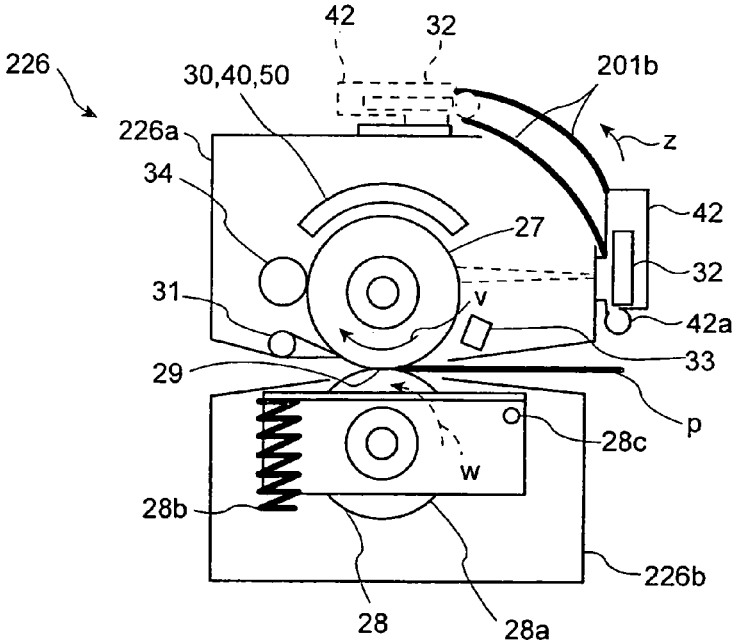
FIG. 7 is a schematic construction diagram of the fixing device viewed from the axial direction of the heat rollers in the second embodiment of the present invention.

At the downstream of the paper P conveying direction of image forming unit 200, a conveying belt 223 to convey paper P, a fixing device 226 shown in FIG. 7, and a paper discharge roller 224 are arranged. Fixing unit 226 conveys a paper P with a toner image transferred in the vertical direction and heats, pressurizes and fixes the toner image in nip 29 in a fixed width between heat roller 27 and pressure roller 28.

Heat roller 27 is supported by a upper frame 226*a* and is rotated in the arrow direction "v". Pressure roller 28 is supported by a lower frame 226*b* and is rotated in the arrow direction "w". Upper and lower frames 226*a* and 226*b* comprise a detachable frame that is moving back and force by sliding in the direction to pull out to the front side of image forming apparatus 100 so that heat roller 27 and pressure roller 28 can be installed or removed to/from image forming apparatus 1.

Temperature sensor 32 detects the surface temperature of heat roller 27 between induction heating coils 30, 40 and 50 to nip 29 and closer to nip 29. Thus, temperature sensor 32 is able to detect the surface temperature immediately before fixing and control the fixing at higher accuracy.

On the outer side surface of upper frame 226*a*, opening 43 is formed and temperature sensor 32 to detect the surface temperature of heat roller 27 without contacting it is provided to each area corresponding to each of induction heating coils 30, 40 and 50. Temperature sensor 32 detects the surface temperature of heat roller 27 between from induction heat coil 30, 40 and 50 to nip 29 and closer to nip 29. Thus, temperature sensor 32 is able to detect the temperature of heat roller 27 immediately before the fixing and control the fixing more precisely.

On the other hand, a rail 201*b* is formed on the rear side of the main body frame of image forming apparatus 100. Further, cleaning pad 37 is provided on the upper surface of upper frame 226*a*. Cleaning pad 37 has at least a width of silicon lens 103 of temperature sensor 32 and is extended in the direction to pull-out fixing device 226 parallel to the axis of heat roller 27.

Supporting plate 42 of temperature sensor 32 is able to support temperature sensor 32 by pressing it against cleaning pad 37 at the temperature detecting position located at the opening 43 of upper frame 226*a* and the evacuation position on the lower surface of upper frame 226*a* by sliding slide pins 42*a* in the arrow direction "z" or the reverse direction along rail 201*b*. The support mechanism is composed of support plate 42 and rail 301.

To pull out upper and lower frames 226*a* and 226*b* to the front side for the maintenance in the image forming, first open the front cover is opened and move support plate 42 in the arrow direction "z" along rail 201*b* formed on the main body frame at the rear side. Temperature sensor is moved to the evacuating position on the lower surface of upper frame 226*a* from the temperature detecting position and pushed against cleaning pad 37.

Then, when upper and lower frames 226*a* and 226*b* are pulled out from the main body of image forming apparatus to the front side, temperature sensor 32 is slid and contacted to cleaning pad 37 that is slid with the sliding of upper and lower frames 226*a* and 226*b*. Thus, the surface of temperature sensor 32 is automatically cleaned and dirt is removed. Further, after completion of the maintenance, upper and lower frames are slid in the direction of the inside of main body of image forming apparatus 100, and when installed in the main body of image forming apparatus 100, the surface of temperature sensor 32 is slid and contacted to cleaning pad 37 and is automatically cleaned.

Hereafter, temperature sensor 32 is returned to the temperature detecting position by moving supporting plate 42 in the direction reverse to the arrow direction "z" along rail 201*b* and image forming apparatus is returned to the temperature detecting position and restored to the state able to make the image forming processing.

According to this embodiment, after temperature sensor 32 is moved to the evacuation position at the time of maintenance, upper and lower frames 226*a* and 226*b* are moved by sliding for detaching/attaching to/from image forming apparatus 1. Thus, the surface of temperature sensor 32 is slide and contacted to cleaning pad 37 to remove dirt on the surface. Accordingly, likewise the first embodiment, the surface of temperature sensor 32 is automatically cleaned without troubling serviceman.

Further, the present invention is not restricted to the embodiments described above but can be modified variously within the scope of the invention and for example, kinds of materials of non-contact temperature detector or response time, etc. are not limited. Further, the construction, operations, etc. of the supporting mechanism are not restricted if it is able to support temperature detectors at the temperature detecting position and the evacuation position. Further, the heat source is not restricted to induction heating coils but a heater may be used for heating and induction heating coils may be provided in the inside of heated material.

What is claimed is:

1. A fixing device of an image forming apparatus comprising;

a heating member to contact a medium and fix a toner image on the medium;

a heat source member to heat the heating member;

a detachable frame to support the heating member detachably to/from a main body of an image forming apparatus;

a non-contact temperature detecting member to detect the surface temperatures of the heating member; and a supporting mechanism to support the temperature detecting member at a temperature detecting position and support the temperature detecting member at an evacuating position when detaching the heating frame.

2. The fixing device of the image forming apparatus according to claim 1, wherein the detachable frame has a cleaning member on an outer wall to clean the temperature detecting member, and the temperature detecting member contacts the cleaning member at the evacuation position.

3. The fixing device of the image forming apparatus according to claim 2, wherein the cleaning member is extending in the direction to detach the detachable frame.

4. The fixing device of the image forming apparatus according to claim 2, wherein the cleaning member is impregnated with cleaning agent.

5. The fixing device of the image forming apparatus according to claim 1, wherein the temperature detecting member is a non-contact thermopile type infrared ray temperature sensor.

6. The fixing device of the image forming apparatus according to claim 5, wherein the detecting wavelength of the infrared ray temperature sensor is 3.07 to 10.81 μm.

7. A fixing device of the image forming apparatus comprising:

heating means for being heated to fix a toner image on a medium by contacting the medium;

heat source means for heating the heating means;

detaching means for supporting the heating means detachably from a main body of the image forming apparatus;

temperature detecting means for detecting the surface temperatures of the heating means without contacting; and supporting means for supporting the temperature detecting means at a temperature detecting position and for supporting the temperature detecting means at an evacuating position when removing/installing the detachable means to/from the main body of the image forming apparatus.

8. The fixing device of the image forming apparatus according to claim 7, wherein the detaching means has cleaning means on an outer wall for cleaning the temperature detecting means and contact the cleaning means at the evacuating position.

9. The fixing device of the image forming apparatus according to claim 8, wherein the cleaning means is extending in the detaching direction of the detaching means.

10. The fixing device of the image forming apparatus according to claim 8, wherein the cleaning means is impregnated with cleaning agent.

11. The fixing device of the image forming apparatus according to claim 7, wherein the temperature detecting means is a non-contact type thermopile type infrared ray temperature sensor.

12. The fixing device of the image forming apparatus according to claim 11, wherein the temperature detecting wavelength of the infrared ray temperature sensors is 3.07 to 10.82 μm.

13. An image forming apparatus comprising:

an image forming unit to form a toner image on paper;

a fixing device that supports at least a heating roller and is detachable to/from a main body of the image forming apparatus;

a non-contact temperature sensor to detect the surface temperature of the heating roller;

a supporting plate to support the temperature sensor; and a guide to lead the supporting plate from a first position to a second position, wherein the first position is a position to detect the temperature of the heating roller by the temperature sensor and the second position is an evacuating position when the fixing device is detached from the main body of the image forming apparatus.

14. The image forming apparatus according to claim 13, wherein a cleaning member is further provided on the outer surface of the fixing device; and the cleaning member contacts the temperature sensor when the temperature sensor is moved to the second position.

15. The image forming apparatus according to claim 14, wherein the fixing device further has an opening between the temperature sensor arranged at the first position and the heating roller.

16. The image forming apparatus according to claim 15, wherein the first position is in the direction to pull out the fixing device and prevent the detachment of the fixing device.

17. The image forming apparatus according to claim 15, wherein the temperature sensor is a thermopile infrared temperature sensor.

18. The image forming apparatus according to claim 13, wherein the cleaning member is impregnated with a cleaning agent.

19. The image forming apparatus according to claim 17, wherein the thermopile infrared temperature sensor is a no-contact thermopile infrared temperature sensor.

* * * * *